US006985050B2

(12) United States Patent
Sengupta et al.

(10) Patent No.: US 6,985,050 B2
(45) Date of Patent: Jan. 10, 2006

(54) WAVEGUIDE-FINLINE TUNABLE PHASE SHIFTER

(75) Inventors: Louise C. Sengupta, Ellicott City, MD (US); Andrey Kozyrev, St. Petersburg (RU)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 09/838,483

(22) Filed: Apr. 19, 2001

(65) Prior Publication Data

US 2002/0033744 A1 Mar. 21, 2002

Related U.S. Application Data

(60) Provisional application No. 60/198,690, filed on Apr. 20, 2000.

(51) Int. Cl.
*H01P 1/18* (2006.01)

(52) U.S. Cl. ..... 333/157; 333/34

(58) Field of Classification Search ..... 333/156, 333/157, 161, 995, 158, 34
See application file for complete search history.

(56) References Cited

U.S. PATENT DOCUMENTS

| | | | | |
|---|---|---|---|---|
| 4,291,415 A | * | 9/1981 | Buntschuh | 455/328 |
| 4,320,404 A | | 3/1982 | Chekroun | |
| 4,434,409 A | | 2/1984 | Green | |
| 4,532,704 A | | 8/1985 | Green | |
| 4,568,893 A | | 2/1986 | Sharma | |
| 4,654,611 A | | 3/1987 | Wong et al. | |
| 4,728,904 A | * | 3/1988 | Swift et al. | 330/286 |
| 4,777,654 A | * | 10/1988 | Conti | 455/327 |
| 4,782,346 A | | 11/1988 | Sharma | |
| 4,789,840 A | | 12/1988 | Albin | |
| 4,818,963 A | | 4/1989 | Green | |
| 4,837,528 A | | 6/1989 | Mörz et al. | |
| 4,894,627 A | | 1/1990 | Kane | |
| 4,982,171 A | | 1/1991 | Figlia et al. | |
| 5,312,790 A | | 5/1994 | Sengupta et al. | |
| 5,355,104 A | | 10/1994 | Wolfson et al. | |
| 5,427,988 A | | 6/1995 | Sengupta et al. | |
| 5,486,491 A | | 1/1996 | Sengupta et al. | |
| 5,635,433 A | | 6/1997 | Sengupta | |
| 5,635,434 A | | 6/1997 | Sengupta | |
| 5,693,429 A | | 12/1997 | Sengupta et al. | |
| 5,724,011 A | | 3/1998 | McWhirter et al. | |
| 5,766,697 A | | 6/1998 | Sengupta et al. | |
| 5,811,830 A | | 9/1998 | Dubey et al. | |

(Continued)

FOREIGN PATENT DOCUMENTS

| | | | |
|---|---|---|---|
| EP | 0050393 A | * | 4/1982 |
| JP | 05251942 | | 9/1993 |

OTHER PUBLICATIONS

A. Kozyrev et al., "Ferroelectric Films: Nonlinear Properties and Applications in Microwave Devices," *IEEE MTT-S International Microwave Symposium Digest*, Jun. 7, 1998, pp. 985-988.

(Continued)

*Primary Examiner*—Benny Lee
(74) *Attorney, Agent, or Firm*—Robert P. Lenart; Donald D. Mondul; James S. Finn

(57) ABSTRACT

A tunable phase shifter includes a waveguide, a finline substrate positioned within the waveguide, a tunable dielectric layer positioned on the finline substrate, a first conductor positioned on the tunable dielectric layer, and a second conductor positioned on the tunable dielectric layer, with the first and second conductors being separated to form a gap. By controlling a voltage applied to the tunable dielectric material, the phase of a signal passing through the waveguide can be controlled.

7 Claims, 4 Drawing Sheets

U.S. PATENT DOCUMENTS 5,830,591 A 11/1998 Sengupta et al.
5,846,893 A 12/1998 Sengupta et al.

OTHER PUBLICATIONS

O. G. Vendik et al., "Ferroelectric Tuning of Planar and Bulk Microwave Devices," *Journal of Superconductivity*, vol. 12, No. 2, Apr. 1999, pp. 325-338.

A. Burgerl et al., Optical Second-Harmonic Generation at Interfaces of Ferroelectric Nanoregions in SrSiO/sub 3/:Ca SrTiO/sub 3/:Ca, *Physical Review B, Condensed Matter*, vol. 53, No. 9, Mar. 1, 1996, pp. 5222-5230.
U.S. Appl. No. 09/394,837.
U.S. Appl. No. 09/644,019.
U.S. Appl. No. 09/768,690.

* cited by examiner

WAVEGUIDE-FINLINE TUNABLE PHASE SHIFTER

CROSS REFERENCE TO RELATED APPLICATION

This application claims the benefit of the filing date of U.S. Provisional Application No. 60/198,690, filed Apr. 20, 2000.

FIELD OF INVENTION

The present invention relates to electronic waveguide devices and more particularly to waveguide-finlines used to control the phase of a guided signal.

BACKGROUND OF INVENTION

Modern communications systems are using increasingly higher frequencies. At high frequencies, communications utilize higher data transmit/receive rates. When steerable array antennas are used in high frequency communications systems, it is desirable for each antenna element to have fast scan capabilities, small size, low cost and reasonable performance. Phase shifters are critical components for meeting those criteria.

Electronic phase shifters are used in many devices to delay the transmission of an electric signal. Waveguide phase shifters have been described in U.S. Pat. Nos. 4,982,171 and 4,654,611. U.S. Pat. No. 4,320,404 discloses a phase shifter using diode switches connected to wire conductors inside a waveguide that are turned on or off to cause a phase shift of the propagating wave. U.S. Pat. Nos. 4,434,409; 4,532,704; 4,818,963; 4,837,528; 5,724,011 and 5,811,830 disclose tuning ferrites, ferromagnetic or ferroelectric slab materials inside waveguides to achieve phase shifting. U.S. Pat. Nos. 4,894,627; 4,789,840 and 4,782,346 disclose devices that use finline structures to build couplers, signal detectors and radiating antennas. These patents either use slab material in a waveguide to construct phase shifters or use finlines for some other application.

Tunable ferroelectric materials are materials whose permittivity (more commonly called dielectric constant) can be varied by varying the strength of an electric field to which the materials are subjected. Even though these materials work in their paraelectric phase above the Curie temperature, they are conveniently called "ferroelectric" because they exhibit spontaneous polarization at temperatures below the Curie temperature. Tunable ferroelectric materials including barium-strontium titanate (BST) or BST composites have been the subject of several patents.

Dielectric materials including barium strontium titanate are disclosed in U.S. Pat. No. 5,312,790 to Sengupta, et al. entitled "Ceramic Ferroelectric Material"; U.S. Pat. No. 5,427,988 to Sengupta, et al. entitled "Ceramic Ferroelectric Composite Material-BSTO-MgO"; U.S. Pat. No. 5,486,491 to Sengupta, et al. entitled "Ceramic Ferroelectric Composite Material-BSTO-$ZrO_2$"; U.S. Pat. No. 5,635,434 to Sengupta, et al. entitled "Ceramic Ferroelectric Composite Material-BSTO-Magnesium Based Compound"; U.S. Pat. No. 5,830,591 to Sengupta, et al. entitled "Multilayered Ferroelectric Composite Waveguides"; U.S. Pat. No. 5,846,893 to Sengupta, et al. entitled "Thin Film Ferroelectric Composites and Method of Making"; U.S. Pat. No. 5,766,697 to Sengupta, et al. entitled "Method of Making Thin Film Composites"; U.S. Pat. No. 5,693,429 to Sengupta, et al. entitled "Electronically Graded Multilayer Ferroelectric Composites"; and U.S. Pat. No. 5,635,433 to Sengupta, entitled "Ceramic Ferroelectric Composite Material-BSTO-ZnO". These patents are hereby incorporated by reference. Copending, commonly assigned U.S. Pat. No. 6,514,895 to Chiu et al. titled "Electronically Tunable Ceramic Materials Including Tunable Dielectric And Metal Silicate Phases", filed Jun. 15, 2000, and U.S. Pat. No. 6,744,077 to Sengupta et al. titled "Electronically Tunable Low-Loss Ceramic Materials Including a Tunable Dielectric Phase and Multiple Metal Oxide Phases", filed Jan. 24, 2001, disclose additional tunable dielectric materials and are also incorporated by reference. The materials shown in these patents exhibit low dielectric loss and high tunability. Tunability is defined as the fractional change in the dielectric constant with applied voltage.

U.S. Pat. Nos. 5,355,104 and 5,724,011 disclose phase shifters that include voltage controllable dielectric materials.

The prior art does not disclose a finline waveguide structure that is used as a tunable phase shifter. There is a need for tunable phase shifters that are relatively simple in structure, low in cost, and can be rapidly controlled.

SUMMARY OF THE INVENTION

Tunable phase shifters constructed in accordance with this invention include a waveguide, a finline substrate positioned within the waveguide, a tunable dielectric layer positioned on the finline substrate, a first conductor positioned on the tunable dielectric layer, and a second conductor positioned on the voltage tunable dielectric layer, with the first and second conductors being separated to form a gap.

By controlling the voltage applied to the conductors, the phase of a signal passing through the waveguide can be controlled.

DETAILED DESCRIPTION OF THE INVENTION

The invention provides a waveguide-finline tunable phase shifter that uses a film of voltage tunable material mounted on a finline. When a DC tuning voltage is applied to the tunable film, the dielectric constant of the film changes, which causes a change in the group velocity, and therefore, produces a phase shift in a signal passing through the waveguide.

Figure 1:
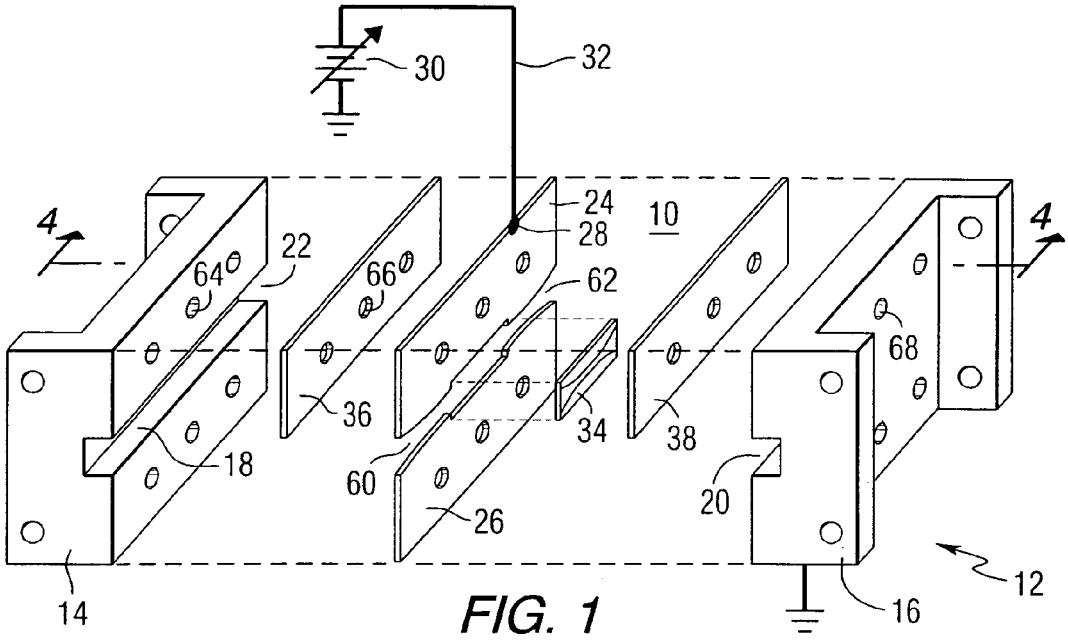
FIG. 1 is an exploded isometric view of a tunable phase shifter constructed in accordance with a first embodiment of the invention.

Referring to the drawings, FIG. 1 is an exploded isometric view of a 30 GHz tunable phase shifter 10 constructed in accordance with a preferred embodiment of the invention. The phase shifter 10 includes a waveguide 12 including side portions 14 and 16. In one embodiment, the waveguide can be a WR-28, 26 to 40 GHz rectangular waveguide. However, the invention is not limited to a particular type of waveguide or frequency of operation. Side portion 14 includes a longitudinal groove 18 and side portion 16 includes a longitudinal groove 20. When the side portions are brought together, the grooves form a channel 22. First and second conductive plates 24 and 26 are positioned between the waveguide portions. Conductive plate 24 includes a connection point 28 for connection to a variable DC voltage source 30 by way of conductor 32. A finline structure 34 is positioned between the conductive plates, which in the preferred embodiment are made of copper. Insulating sheets 36 and 38 are positioned on opposite sides of conductive plate 24 to insulate it from the conductive waveguide portions. In the preferred embodiment, the insulating sheets are made of mica. Conductive plate 26 is allowed to make electrical contact with the waveguide portions and is connected to an electrical ground either directly, or through the waveguide portions.

Figure 2:
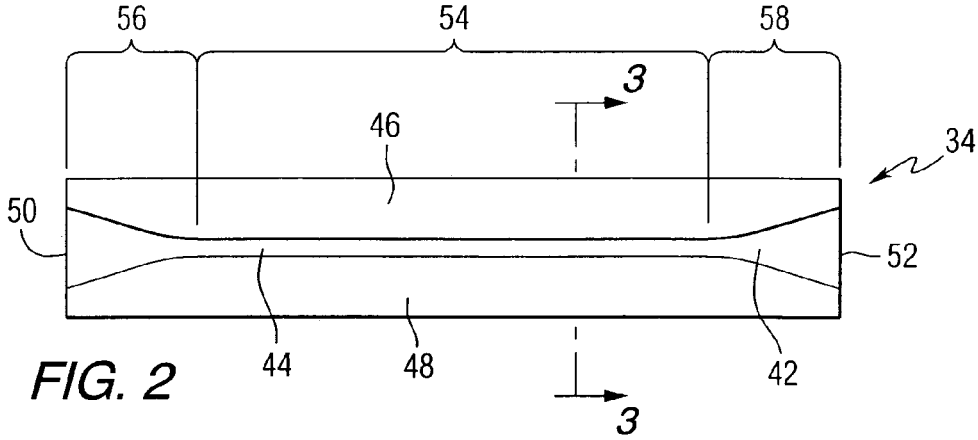
FIG. 2 is a side elevation view of a finline structure the may be used in the phase shifter of FIG. 1.
Figure 3:
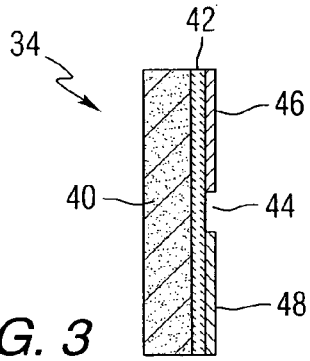
FIG. 3 is a cross-sectional view of the finline of FIG. 2 taken along line 3—3.

FIG. 2 is a side elevation view of a finline structure 34 that may be used in the phase shifter of FIG. 1, and FIG. 3 is a cross-sectional view of the finline structure 34 taken along line 3—3 in FIG. 2. Finline structure 34 includes a low dielectric constant, low loss substrate 40 (see FIG. 3) with a layer of tunable material 42 deposited thereon. The preferred embodiment of this invention utilizes MgO as the substrate material. The tunable material is metalized with conductive material to form electrodes 46 and 48 that define a gap 44, which separates the electrodes 46 and 48 on the tunable material layer, as best shown in FIG. 3. The gap extends longitudinally from a first end 50 to a second end 52 of the structure. The gap includes a central portion 54 and first and second exponentially tapered end portions 56 and 58 respectively (see FIG. 2). The end portions are tapered such that the gap widens near the ends to provide impedance matching. Referring to FIG. 1, conductive plates 24 and 26 form exponentially tapered gaps 60 and 62 to provide additional impedance matching. Gaps 60 and 62 lie adjacent to the ends of gap portions 56 and 58 respectively. A plurality of openings, for example 64, 66 and 68, are located in the various components of the phase shifter of FIG. 1 for receiving fasteners that will be used to hold the phase shifter together.

The finline structure is constructed in a unilateral configuration, and in this example, no circuit or metalization is on the rear surface of the substrate 40. The tunable dielectric film on the front of the finline structure is metalized to form two electrodes 46 and 48 (as shown in FIGS. 2 and 3). In the preferred embodiment, the tunable dielectric film can be a thin film ranging from 0.2 to 2.0 3m in thickness, or a thick film ranging from 2 to 30 3m in thickness, with a dielectric constant ranging from 30 to 2000. The exponentially tapered gaps in the metalization on the tunable dielectric material match the impedance at the ends to that of the center tunable region. The center tunable region includes a gap 54 (see FIG. 2) between two generally parallel edges of the metalized conductors with the width of the gap ranging from about 2 to about 50 ③m to form a capacitor. At each end of the tuning region, the same matching structure is mirrored to convert the impedance to that of the free space waveguide.

Figure 4:
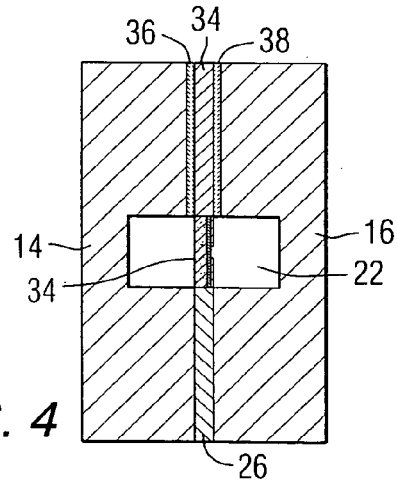
FIG. 4 is a cross-sectional view of an assembled version of the waveguide phase shifter of FIG. 1 taken along line 4—4.

FIG. 4 is a cross-sectional view of an assembled version of the finline of FIG. 1 taken along line 4—4. In this view, the transverse orientation of the finline structure within the channel 22 can be seen. In addition, this view shows that conductive plate 26 is electrically connected to the waveguide portions 14 and 16.

DC biasing via the metalized conductors controls the phase shifting. The top conductive plate is isolated using insulating films to prevent voltage breakdown. The bottom part of the finline structure is connected to the waveguide wall or ground.

Figure 5:
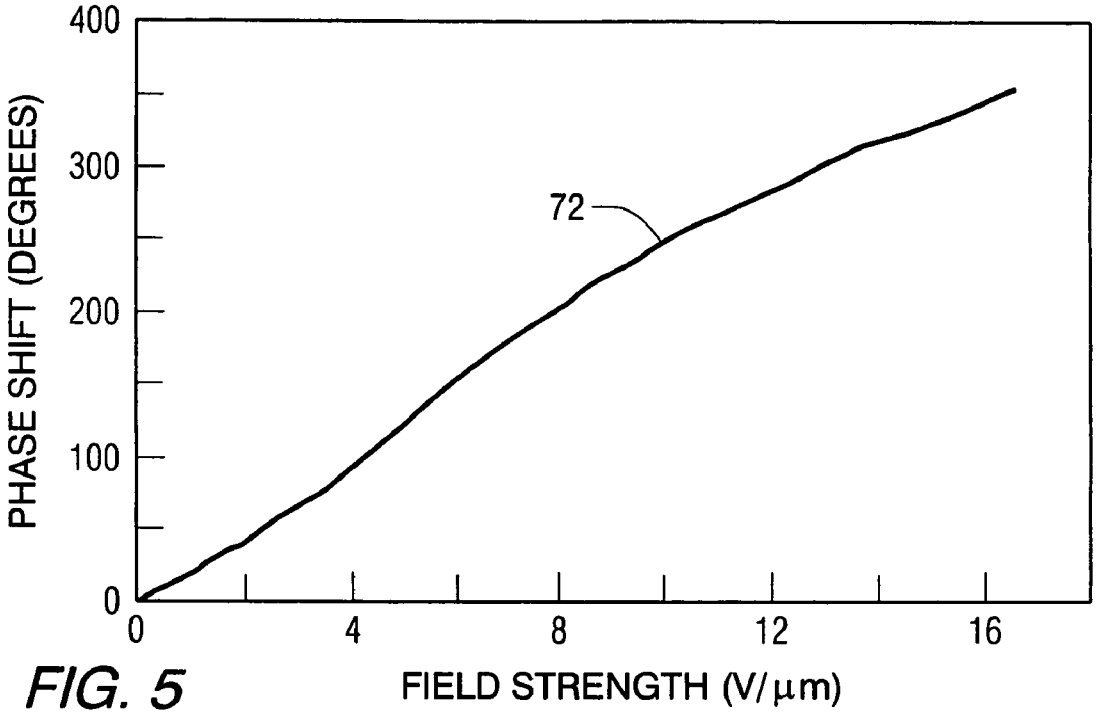
FIG. 5 is graph of the phase shift versus bias voltage for a phase shifter constructed in accordance with the invention.

FIG. 5 is graph of the phase shift versus bias voltage for a phase shifter constructed in accordance with the invention. Curve 72 represents data obtained at 300° K.

Figure 6:
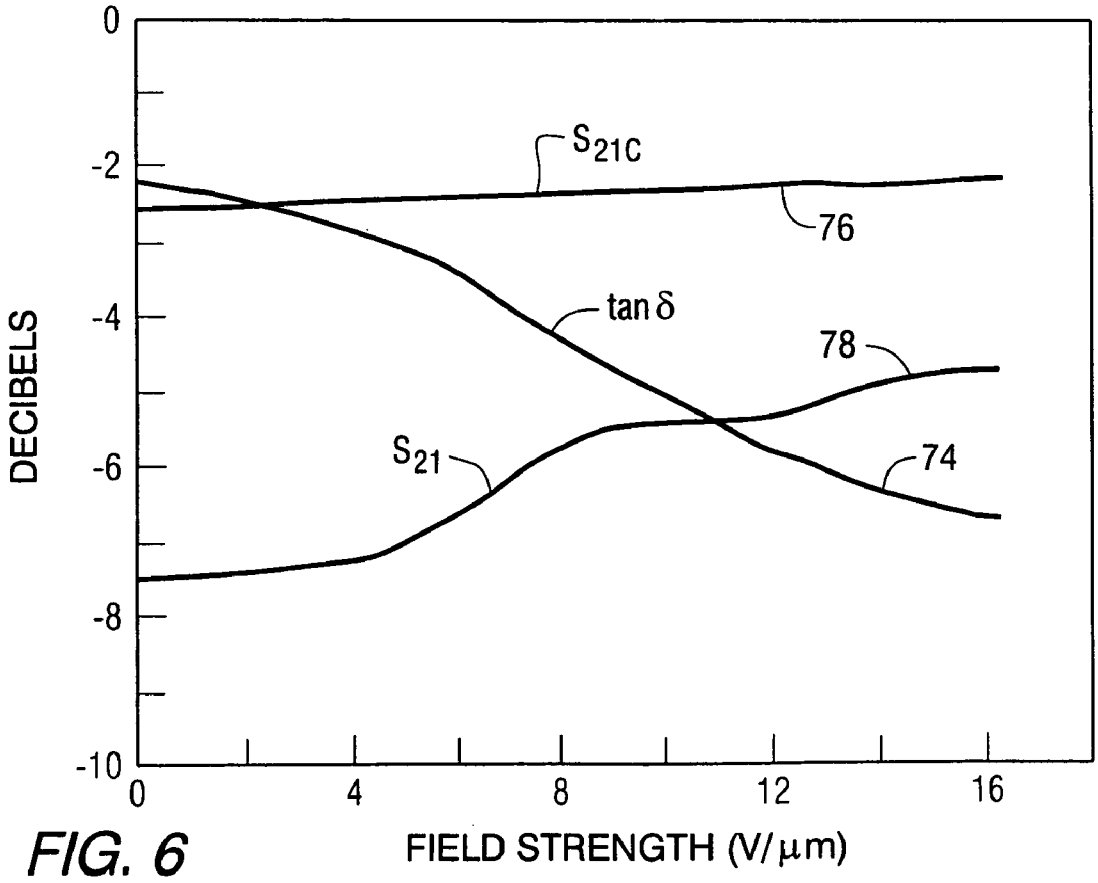
FIG. 6 is graph of the losses versus bias voltage for a phase shifter constructed in accordance with the invention.

FIG. 6 is graph of the losses versus bias voltage for a phase shifter constructed in accordance with the invention. Curve 74 represents the calculated loss tangent (tanδ) Curve 78 represents the test results of a phase shifter with a calculated conductor loss $S_{21}$ dB. Curve 76 represents the measured test results of a phase shifter configured according to the present invention with a biasing voltage applied to yield a conductor loss $S_{21C}$ dB. Conductor loss $S_{21C}$ dB is less than calculated conductor loss $S_{21}$ dB (curve 78).

The finline mode will propagate through the parallel gap portion of the finline structure. Due to the tunable film dielectric constant decreasing under the biasing voltage, the guided signal will change its phase velocity when passing through this region. For a 360° phase shift, the total length, L, needed is:

$$L = \frac{\lambda_g}{1 - \sqrt{1 - T}}$$

where T is the tunability, and $\lambda_g$ is the wavelength of a signal guided through the device.

Another method for estimating tunability is using the capacitance variance ratio, such as the ratio, K, of C1, the tuning section capacitance before biasing, to C2, the capacitance after biasing. That is: K=C1/C2. Since the physical dimensions are not changing, this ratio represents the change of effective dielectric constant $K=\epsilon_{e1}/\epsilon_{e2}$, and K= 1/(1−T), where $\epsilon_{e1}$ represents the dielectric constant at zero bias voltage and $\epsilon_{e2}$ represents the dielectric constant at a predetermined bias voltage. For example, a finline phase shifter can have a K of about two, or a tunability of about 50%.

The biasing voltage required to generate a 360° phase shift is about a few hundred volts. FIG. 5 shows the phase response versus biasing voltage, which is approximately a linear relationship. FIG. 6 shows the test results of the phase shifter, indicating that insertion loss is better under the biasing voltage. That is because both the dielectric constant and the loss tangent are decreased under biasing voltage. A way to estimate the performance of the device is using the figure of merit, which is defined as:

$$F = \frac{\Delta\phi}{\sqrt{S_{21}(0v)\cdot S_{21}(400v)}} \text{ (degree/dB)}$$

where $\Delta\phi$ is the total phase change under biasing voltage and $S_{21}$ is the loss in dB.

This invention provides electronic phase shifters that operate at room temperature and include voltage tunable materials. When a DC tuning voltage is applied to the tunable material, the dielectric constant of the material changes, which causes a change in the group velocity and therefore produces a controllable phase shift.

Figure 7:
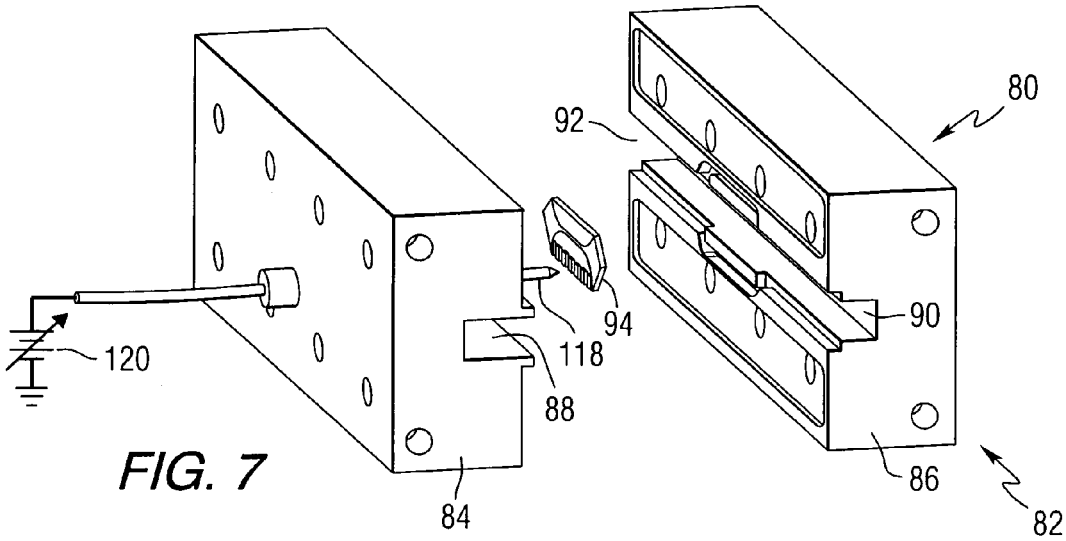
FIG. 7 is an exploded isometric view of another tunable phase shifter constructed in accordance with the invention.

FIG. 7 is an exploded isometric view of another tunable phase shifter 80 constructed in accordance with an alternative embodiment of the invention. The phase shifter 80 includes a waveguide 82 including side portions 84 and 86. Side portion 84 includes a longitudinal groove 88 and side portion 86 includes a longitudinal groove 90. When the side portions are brought together, the grooves form a channel 92. A finline structure 94 is positioned between the side portions of the waveguide.

Figure 8:
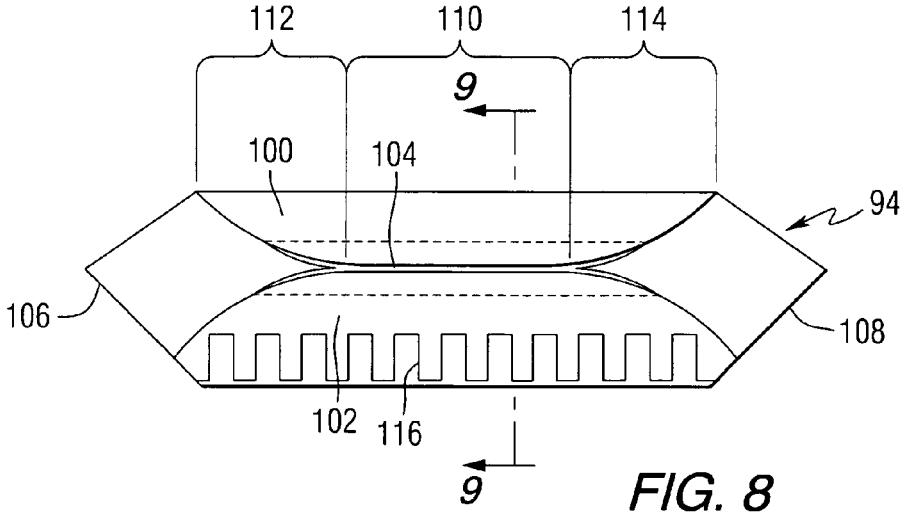
FIG. 8 is a side elevation view of a finline structure the may be used in the phase shifter of FIG. 7.
Figure 9:
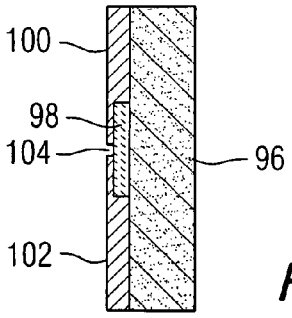
FIG. 9 is a cross-sectional view of the finline of FIG. 8 taken along line 9—9.

FIG. 8 is a side elevation view of a finline structure 94 that may be used in the phase shifter of FIG. 7, and FIG. 9 is a cross-sectional view of the finline structure 94 taken along line 9—9. Finline structure 94 (see FIG. 7) includes a low dielectric constant, low loss substrate 96 (see FIG. 9) with a layer of tunable material 98 (see FIG. 9) deposited thereon. The preferred embodiment of this invention utilizes MgO as the substrate material. The tunable material is metalized with conductive material to form electrodes 100 and 102 that define a gap 104, which separates the electrodes 100 and 102 on the tunable material layer (as best seen in FIG. 8). The gap extends longitudinally from a first end 106 to a second end 108 of the structure. The gap includes a central portion 110 and first and second exponentially tapered end portions 112 and 114 respectively. The end portions are tapered such that the gap widens near the ends to provide impedance matching. Electrode 102 has a relatively large surface area so that it provides an RF ground to the waveguide structure. In addition, in the embodiment shown in FIG. 8, electrode 102 includes and RF choke design 116 to ensure the RF ground and DC isolation.

The embodiment shown in FIGS. 7, 8 and 9 uses a spring loaded contact 118 to connect the bias voltage from voltage source 120 to one of the metalized layers on the tunable material (as shown in FIG. 7). This design reduces the size and simplifies the structure. Furthermore, the first electrode 100 is DC grounded, while the second electrode 102 is DC biased and forms an RF ground. The RF ground can be provided via the large area of electrode, or through an RF choke design as shown in FIG. 8, on the substrate to ensure an RF ground.

Figure 10:
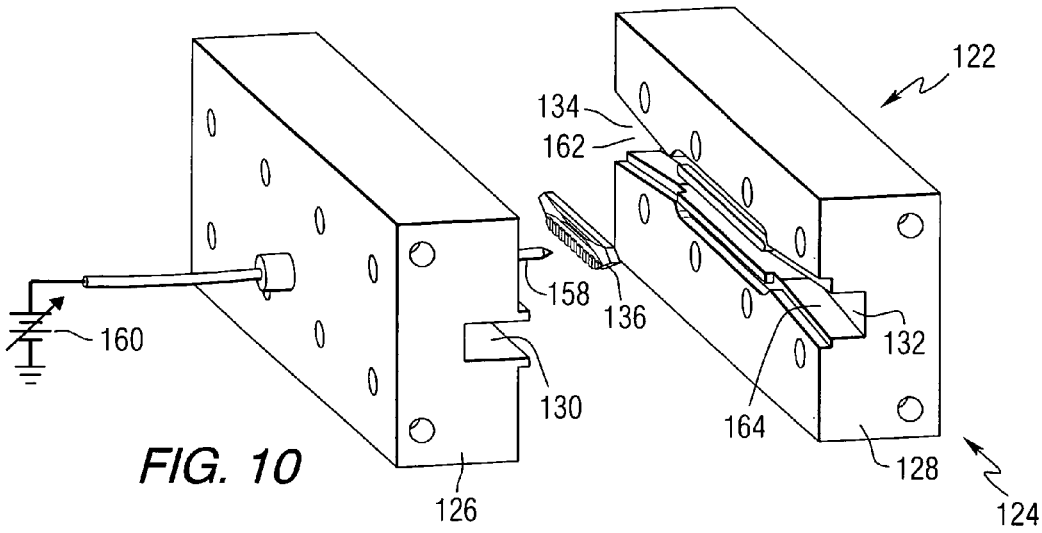
FIG. 10 is an exploded isometric view of another tunable phase shifter constructed in accordance with the invention.

FIG. 10 is an exploded isometric view of another tunable phase shifter 122 constructed in accordance with another alternative embodiment of the invention. The phase shifter 122 includes a waveguide 124 including side portions 126 and 128. Side portion 126 includes a longitudinal groove 130 and side portion 128 includes a longitudinal groove 132. When the side portions are brought together, the grooves from a channel 134. A finline structure 136 is positioned between the side portions of the waveguide.

Figure 11:
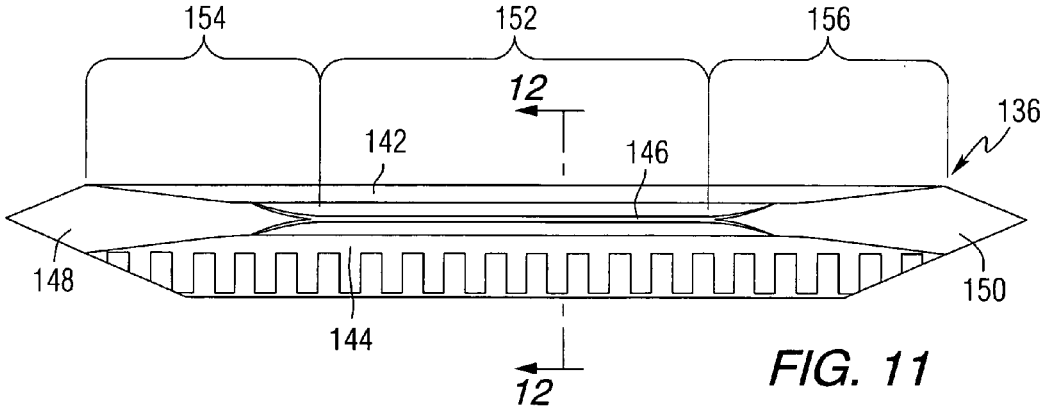
FIG. 11 is a side elevation view of a finline structure the may be used in the phase shifter of FIG. 10.
Figure 12:
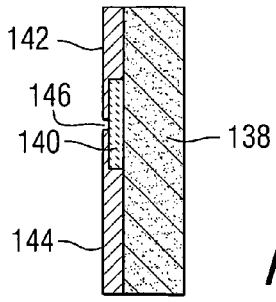
FIG. 12 is a cross-sectional view of the finline of FIG. 11 taken along line 12—12.

FIG. 11 is a side elevation view of a finline structure 136 that may be used in the phase shifter of FIG. 10, and FIG. 12 is a cross-sectional view of the finline structure 136 taken along line 11—11 (in FIG. 11). Finline structure 136 includes a low dielectric constant, low loss substrate 138 with a layer of tunable material 140 deposited thereon (as shown in FIG. 12). The preferred embodiment of this invention utilizes MgO as the substrate material. The tunable material is metalized with conductive material to form electrodes 142 and 144 that define a gap 146, which separates the electrodes 142 and 144 on the tunable material layer (best shown in FIG. 11). The gap extends longitudinally from a first end 148 to a second end 150 of the structure. The gap includes a central portion 152 and first and second exponentially tapered end portions 154 and 156 respectively. The end portions are tapered such that the gap widens near the ends to provide impedance matching.

The embodiment shown in FIGS. 10, 11 and 12 uses a spring loaded contact 158 to connect the bias voltage from voltage source 160 to one of the metallized layers on the tunable material (as shown in FIG. 10). This design reduces the size and simplifies the structure. Furthermore, the first electrode is DC grounded, while the second electrode is DC biased with an RF ground. The RF ground can be provided via the large area of the electrode, or by an RF choke design on the substrate to ensure RF ground and DC isolation.

Referring to FIG. 10, channel forms tapered sections 162 and 164 to provide additional impedance matching. The tapered section lies adjacent to the ends of gap portions 154 and 156. The embodiment shown in FIGS. 10, 11 and 12 uses a non-standard waveguide to optimize the phase shifter. The non-standard waveguide would then be coupled to a standard waveguide.

In the preferred embodiment the tunable dielectric layer is preferably comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO-MgO, BSTO-$MgAl_2O_4$, BSTO-$CaTiO_3$, BSTO-$MgTiO_3$, BSTO-$MgSrZrTiO_6$, and combinations thereof. Other tunable dielectric materials may be used partially or entirely in place of barium strontium titanate. An example is $Ba_xCa_{1-x}TiO_3$, where x ranges from 0.2 to 0.8, and preferably from 0.4 to 0.6. Additional alternative tunable ferroelectrics include $Pb_xZr_{1-x}TiO_3$ (PZT) where x ranges from 0.05 to 0.4, lead lanthanum zirconium titanate (PLZT), lead titanate ($PbTiO_3$), barium calcium zirconium titanate ($BaCaZrTiO_3$), sodium nitrate ($NaNO_3$), $KNbO_3$, $LiNbO_3$, $LiTaO_3$, $PbNb_2O_6$, $PbTa_2O_6$, $KSr(NbO_3)$, and $NaBa_2(NbO_3)_5$ and $KH_2PO_4$. In addition, the present invention can include electronically tunable materials having at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KAlSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

This invention utilizes a finline structure that is disposed within a waveguide. The structure includes a low loss substrate and a tunable dielectric film. The tunable film is metalized to form two conductors. Impedance matching is provided by using exponentially tapered sections of a gap between the conductors. In one embodiment, at the leading edge of the waveguide, two copper plate sections match free-space waveguide to the dielectric substrate, which is sandwiched between the copper plates. On the dielectric substrate, tapered metalized sections on the tunable film match the impedance to the center tunable region.

This invention takes advantage of a high dielectric constant of voltage tunable thick film materials, such as BSTO, to build a 360° waveguide-finline phase shifter.

The phase shifters of this invention can be electronically tuned to provide repeatable and stable phase shifts. Since the tunable material is a good insulator, the DC power consumption of the tuning voltage supply is very low, with a current typically less than a microampere. The voltage tuned phase shifters have the advantage of fast tuning, good tunability, small size, simple control circuits, low power consumption, and low cost. In addition, the phase shifters show good linear behavior and can be radiation hardened.

An example of an application of the phase shifters of this invention is in phased array antennas. An array of radiating elements generates a specified beam pattern, with each element controlled by a phase shifter and the array of elements working together to form a beam in a desired direction. A 360° phase shifter can direct the radiating electromagnetic energy to any specified direction without mechanically moving the radiating element. By assembling a number of antenna elements to form a phased array, the direction of the main lobe of the beam, can be controlled. This is achieved through the adjustment of the signal amplitude and phase of each antenna element in the array. The advantage of phase array antennas is their accurate pointing of the beam in the specified direction that minimizes radiation in unwanted directions, and improves the signal-to-noise ratio and overall efficiency of the system.

In phased array antenna applications, the phase control needs to be accurate, reliable and fast. By using the present tunable phase shifter in phased array antennas, an accurate phase shift will be easier to obtain by tuning a DC voltage. The phase shift versus tuning voltage is an approximately linear relationship. In addition, higher power applications can be realized by using waveguide structure phase shifters.

While the present invention has been described in terms of what are at present believed to be its preferred embodiments, it will be apparent to those skilled in the art that various changes may be made to the disclosed embodiments without departing from the scope of the invention as defined by the following claims.

What is claimed is:

1. A device comprising;

a waveguide;

a finline substrate positioned within the waveguide;

a tunable dielectric layer positioned on the finline substrate, wherein the tunable dielectric layer comprises a barium strontium titanate (BSTO) composite containing materials that enable low insertion loss and phase tuning at room temperature;

a first conductor positioned on the tunable dielectric layer; and a second conductor positioned on the tunable dielectric layer, the first and second conductors being separated to form a gap having a minimum width ranging from 2 micron to 50 micron; the tunable dielectric layer comprising an electronically tunable dielectric phase and at least two metal oxide phases.

2. A device comprising;

a waveguide;

a finline substrate positioned within the waveguide;

a tunable dielectric layer positioned on the finline substrate, wherein the tunable dielectric layer comprises a barium strontium titanate (BSTO) composite containing materials that enable low insertion loss and phase tuning at room temperature;

a first conductor positioned on the tunable dielectric layer; and a second conductor positioned on the tunable dielectric layer, the first and second conductors being separated to form a gap having a minimum width ranging from 2 micron to 50 micron;

the gap extending from a first end of the tunable dielectric layer to a second end of the tunable dielectric layer;

the gap including a first end, a center portion and a second end; and the gap including exponentially tapered portions adjacent to said first and second ends.

3. The device according to claim 2, wherein the tunable dielectric layer comprises a barium strontium titanate (BSTO) composite; the composite comprising at least one substance selected from the group of:

BSTO-MgO, BSTO-$MgAl_2O_4$, BSTO-$CaTiO_3$, BSTO-$MgTiO_3$, BSTO-$MgSrZrTiO_6$.

4. A device comprising;

a waveguide;

a finline substrate positioned within the waveguide;

a tunable dielectric layer positioned on the finline substrate, wherein the tunable dielectric layer comprises a barium strontium titanate (BSTO) composite containing materials that enable low insertion loss and phase tuning at room temperature;

a first conductor positioned on the tunable dielectric layer;

a second conductor positioned on the tunable dielectric layer, the first and second conductors extending between a first end and a second end and being separated to form a gap having a minimum width ranging from 2 micron to 50 micron; and an impedance matching section formed by at least one exponentially tapered gap between the first and second conductors; the at least one exponentially tapered gap being situated adjacent at least one of the first end and the second end.

5. A device comprising;

a waveguide;

a finline substrate positioned within the waveguide;

a tunable dielectric layer positioned on the finline substrate, wherein the tunable dielectric layer comprises a composite material that enables low insertion loss and phase tuning at room temperature; the composite material being comprised of at least one substance selected from the group of:

$Mg_2SiO_4$, $CaSiO_3$, $BaSiO_3$, $SrSiO_3$, $Na2SiO_3$, $NaSiO_3$-$5H_2O$, $LiAlSiO_4$, $LiSiO_3$, $Li_4SiO_4$, $Al_2Si_2O_7$, $ZrSiO_4$, $KAlSi_3O_8$, $NaAlSi_3O_8$, $CaAl_2Si_2O_8$, $CaMgSi_2O_6$, $BaTiSi_3O_9$ and $Zn_2SiO_4$;

a first conductor positioned on the tunable dielectric layer; and a second conductor positioned on the tunable dielectric layer, the first and second conductors being separated to form a gap having a minimum width ranging from 2 micron to 50 micron.

6. A device comprising:

a waveguide;

a finline substrate positioned within the waveguide;

a tunable dielectric layer positioned on the finline substrate, wherein the tunable dielectric layer comprises a barium strontium titanate (BSTO) composite containing materials that enable low insertion loss and phase tuning at room temperature;

a first conductor positioned on the tunable dielectric layer; and a second conductor positioned on the tunable dielectric layer, the first and second conductors being separated to form a gap having a minimum width ranging from 2 micron to 50 micron; the second conductor comprising an RF choke.

7. A device comprising;

a waveguide;

a finline substrate positioned within the waveguide;

a tunable dielectric layer positioned on the finline substrate, wherein the tunable dielectric layer comprises a barium strontium titanate (BSTO) composite containing materials that enable low insertion loss and phase tuning at room temperature;

a first conductor positioned on the tunable dielectric layer; and a second conductor positioned on the tunable dielectric layer, the first and second conductors being separated to form a gap having a minimum width ranging from 2 micron to 50 micron; the waveguide including first and second sections, and the device further comprising:

a first conductive plate positioned between the first and second sections of the waveguide; and a second conductive plate positioned between the first and second sections of the waveguide, the first conductive plate being insulated from the waveguide and the second conductive plate being electrically connected to the waveguide.

* * * * *